US006840054B2

(12) United States Patent
Pitla et al.

(10) Patent No.: US 6,840,054 B2
(45) Date of Patent: Jan. 11, 2005

(54) CONTROL STRATEGY OF A VARIABLE DISPLACEMENT COMPRESSOR OPERATING AT SUPER CRITICAL PRESSURES

(75) Inventors: Srinivas S. Pitla, Farmington Hills, MI (US); Vipen Khetarpal, Novi, MI (US); Yong Huang, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 194 days.

(21) Appl. No.: 10/027,548

(22) Filed: Dec. 21, 2001

(65) Prior Publication Data

US 2003/0115897 A1 Jun. 26, 2003

(51) Int. Cl.[7] ..... F04B 1/26; F25B 1/00
(52) U.S. Cl. ..... 62/228.5
(58) Field of Search ..... 417/222.2; 62/228.5, 62/229

(56) References Cited

U.S. PATENT DOCUMENTS 5,145,326 A * 9/1992 Kimura et al. ..... 417/222.2
5,584,670 A 12/1996 Kawaguchi et al. ..... 417/222.2
5,865,604 A 2/1999 Kawaguchi et al. ..... 417/222.2
6,010,312 A * 1/2000 Suitou et al. ..... 417/222.2
6,056,513 A 5/2000 Kawaguchi et al. ..... 417/222.2
6,073,456 A 6/2000 Kawai et al. ..... 62/133
6,105,380 A 8/2000 Yokomachi et al. ..... 62/228.3
6,247,900 B1 * 6/2001 Archibald et al. ..... 62/228.5

FOREIGN PATENT DOCUMENTS

EP 1 018 446 12/2000 ..... B60H/1/32

* cited by examiner

*Primary Examiner*—William Wayner
(74) *Attorney, Agent, or Firm*—Brinks Hofer Gilson & Lione

(57) ABSTRACT

An air conditioning system for cooling a vehicle passenger compartment is disclosed. The system includes an air duct, a refrigerant circuit, a variable displacement compressor, and a controller. The air duct directs air conditioned air into the vehicle passenger compartment. The refrigerant circuit circulates a refrigerant, wherein a first portion of the circuit is exposed to the air duct and a second portion of the circuit is exposed to air external of the vehicle passenger compartment. The variable displacement compressor is in fluid communication with the refrigerant circuit, wherein the compressor has a control valve for regulating refrigerant flow between a compressor crankcase and a compressor discharge chamber and between the compressor crankcase and a compressor suction chamber. The controller in electrical communication with the variable displacement compressor for controlling refrigerant flow and a displacement of the compressor by actuating the control valves.

10 Claims, 3 Drawing Sheets

CONTROL STRATEGY OF A VARIABLE DISPLACEMENT COMPRESSOR OPERATING AT SUPER CRITICAL PRESSURES

FIELD OF THE INVENTION

The present invention relates to systems and methods for controlling the operation of automotive air conditioning compressors, especially variable displacement compressors which may be regulated for optimal operation for a particular engine operating state and a particular environmental condition.

BACKGROUND ART

Electronically controlled automotive air conditioning compressors are well known in the prior art. Typically, prior art electronically controlled compressor systems include an electronic control module (ECM) in communication with various sensors for measuring vehicle interior and exterior environmental conditions, switches for actuating various air conditioning system modes and output ports for relaying output signals to actuate various system components such as vent doors, blower motor, fans, and valves. These electronically controlled compressors require a control strategy to optimize the system requirements. Without a control strategy capable of optimizing the performance of the air conditioning system, there is little justification for electronically controlling the compressor as compared to mechanically controlling the compressor. Generally, electronically controlled compressor systems weigh more, are more expensive, and require additional sensors as compared to their mechanical counterparts.

However, with optimum control of the electronically controlled compressor systems, the inefficiencies of mechanically controlled compressors caused by a sharp reduction in the evaporator temperature (typically around 35 F.) may be avoided. Automotive air conditioning systems having mechanically controlled compressors operate inefficiently (do more work than is required) in the vast majority of operating conditions.

Therefore, what is needed is a new and improved system and method for controlling electronically controlled automotive air conditioning compressors. The new and improved system and method should not run the compressor unnecessarily. Moreover, it should provide more precise control over the pressures disclosed in the respective compressor chambers.

SUMMARY

In an aspect of the present invention, an air conditioning system for cooling a vehicle passenger compartment is provided. The system includes an air duct, a refrigerant circuit, a variable displacement compressor, and a controller. The air duct directs air conditioned air into the vehicle passenger compartment. The refrigerant circuit circulates a refrigerant, wherein a first portion of the circuit is exposed to the air duct and a second portion of the circuit is exposed to air external of the vehicle passenger compartment. The variable displacement compressor is in fluid communication with the refrigerant circuit, wherein the compressor has a control valve for regulating refrigerant flow between a compressor crankcase and a compressor discharge chamber and between the compressor crankcase and a compressor suction chamber. The controller in electrical communication with the variable displacement compressor for controlling refrigerant flow and a displacement of the compressor by actuating the control valves.

In another aspect of the present invention the electronic control valve is comprised of two separate control valves a first for regulating refrigerant flow between a compressor crankcase and a compressor discharge chamber and a second for regulating refrigerant flow between the compressor crankcase and a compressor suction chamber.

In yet another aspect of the present invention, a method for controlling an air conditioning system for cooling a vehicle passenger compartment is provided. The method includes directing air conditioned air into the vehicle passenger compartment using an air duct, circulating a refrigerant through a refrigerant circuit wherein the circuit has a first portion exposed to the air within the air duct and a second portion exposed to air external of the passenger compartment, compressing the refrigerant using a variable displacement compressor, wherein the compressor has a control valve for regulating refrigerant flow, and controlling the flow of refrigerant through the refrigerant circuit and the compressor using a controller by actuating the control valve until a predetermined interior passenger compartment climate is achieved.

In still another aspect of the present invention, controlling the flow further includes regulating refrigerant flow between a compressor crankcase and a compressor discharge chamber and between the compressor crankcase and a compressor suction chamber using two separate control valves.

In still another aspect of the present invention controlling the flow further comprises changing a displacement of the compressor by actuating the control valve to change the inclination of a swashplate disposed within the compressor.

In still another aspect of the present invention, an air conditioning system for cooling a vehicle passenger compartment. The system has an air duct, a refrigerant circuit, a variable displacement compressor and a controller. The air duct directs air conditioned air into the vehicle passenger compartment. The refrigerant circuit circulates a refrigerant, wherein a first portion of the circuit is exposed to the air duct and a second portion of the circuit is exposed to air external of the vehicle passenger compartment. The variable displacement compressor is in fluid communication with the refrigerant circuit, wherein the compressor has a first electronic control valve for regulating refrigerant flow between a compressor crankcase and a compressor discharge chamber and a second electronic control valve for regulating refrigerant flow between the compressor crankcase and a compressor suction chamber. The controller in electrical communication with the variable displacement compressor for controlling refrigerant flow and a displacement of the compressor by actuating the first and second electronic control valves.

Further aspects, features and advantages of the invention will become apparent from consideration of the following erudite description and the appended claims when taken in connection with the accompanying drawings.

DETAILED DESCRIPTION OF THE INVENTION

Figure 1:
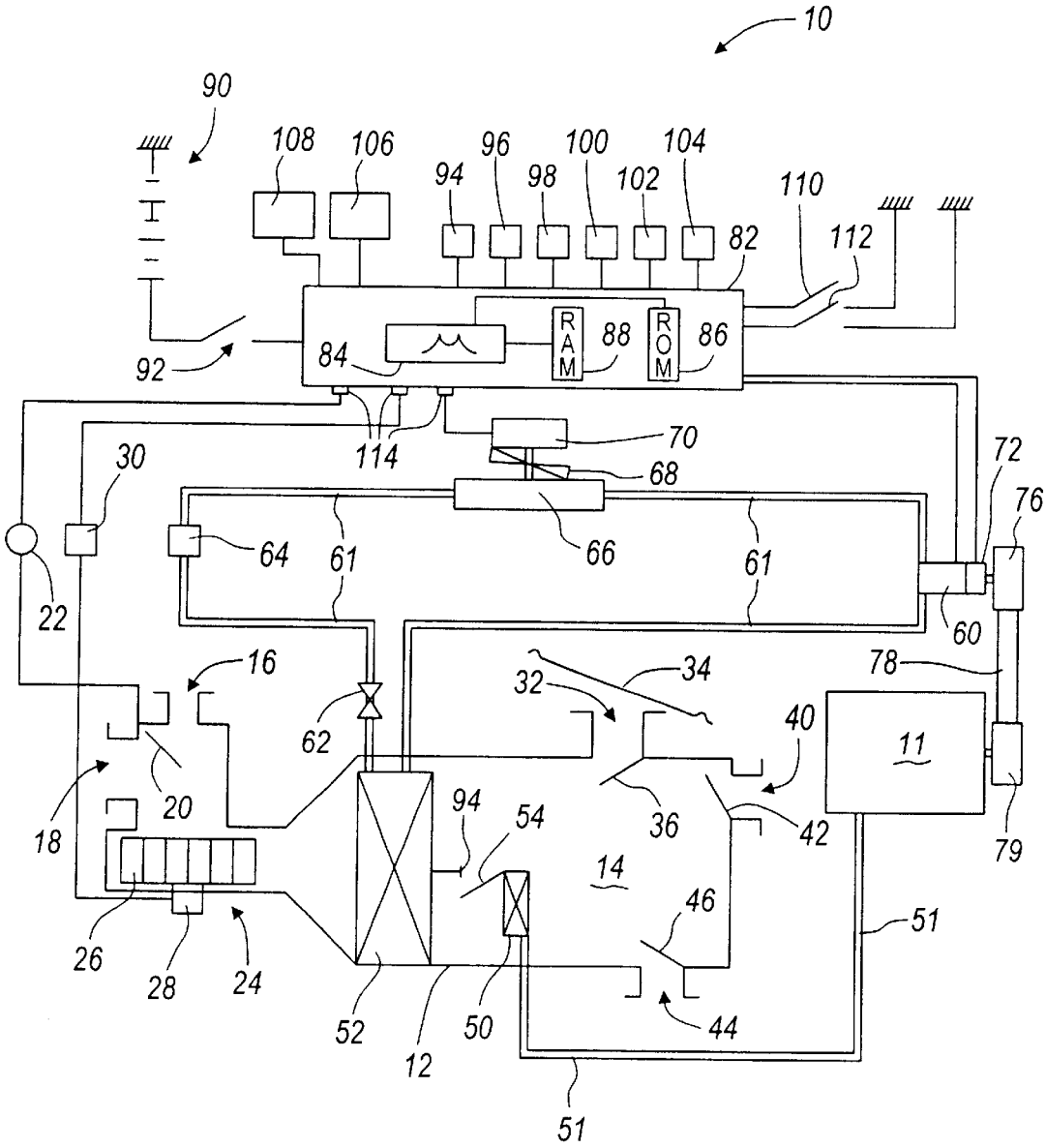
FIG. 1 is a schematic diagram illustrating an automotive air conditioning system, in accordance with the present invention.

Referring now to FIG. 1, an automotive air conditioning system 10 is schematically represented, in accordance with the present invention. System 10 includes an air conditioning duct 12 which defines an air passage 14 for directing conditioned air into a passenger compartment.

Air conditioning duct 12 includes a plurality of inlets and outlets for drawing in outside air and for expelling conditioned air into the passenger compartment. For example, the inlets include an outdoor air inlet 16 for drawing in outside air, and an inside air recirculation inlet 18 for recirculating air contained within the passenger compartment. A mode selector door 20 driven by a small motor 22 is provided to allow a passenger to select between an outside intake mode and an inside air recirculation mode.

Further, a blower 24 such as a centrifugal blower is provided within air conditioning duct 12 for producing air flow from the air inlets to the air outlets. Blower 24 further includes a centrifugal fan 26 and a motor 28. Motor 28 is controlled by a motor driver circuit 30.

Air conditioning duct 12 further includes a plurality of air outlets for directing air conditioned air into various parts of the passenger compartment. More specifically, a defroster outlet 32 is provided for directing conditioned air into a vehicle windshield 34. A defroster mode is selected by actuating a defroster door 36. Further, an upper body air outlet 40 is provided for directing conditioned air toward a vehicle occupant's upper body. An upper body selection mode is selected by actuating an upper body air mode door 42. Similarly, a foot air outlet 44 is provided for directing conditioned air towards the feet of vehicle occupant. Preferably, a foot air mode door 46 is provided for selecting a foot air mode.

With continuing reference to FIG. 1, a heater unit 50 having a heater core is provided for heating cold air passing by an evaporator unit 52. Typically, the heater core is supplied with heated water coolant via coolant conduits 51 from the engine 11. During the heating cycle of the air conditioning system, the heater unit 50 operates as a heat exchanger using the heater water coolant to heat the cold air passing through the evaporator 52. An air regulator door 54 is provided for regulating the amount of air heated by heater unit 50.

Evaporator 52 is in fluid communication with a compressor 60 via refrigerant tubes 61. Compressor 60 is preferably a variable displacement compressor which draws in refrigerant, compresses the refrigerant and discharges the refrigerant. Evaporator 52 is also in communication with an expansion valve 62. Expansion valve 62 expands the liquid refrigerant fed from a receiver 64. Receiver 64 performs vapor liquid separation of the refrigerant fed from a condenser 66. Condenser 66 condenses and liquefies the refrigerant fed from compressor 60 through heat exchange with outdoor air. Condenser 66 is cooled by a cooling fan 68 which is driven by a driver motor 70.

Compressor 60 may further include an electromagnetic clutch 72 or coilless clutch. When present, the clutch is operatively coupled to compressor drive pulley 76 for engaging and disengaging a drive belt 78. Drive belt 78 is driven by an engine drive pulley 79 of engine 11.

An air-conditioning system control unit 82 (ACU) is further provided for controlling the operation of the air conditioning system in accordance with the present invention. Air-conditioning control unit 82 includes a microprocessor 84, read only memory (ROM) 86, and random access memory (RAM) 88 and other conventional computer components. The ACU is supplied power by the vehicle battery 90 when the ignition switch 92 is switched on. A plurality of switches and sensors are in communication with ACU 82 for sending electrical signals to ACU 82. These electrical signals are indicative of air conditioning environmental factors necessary for determining how to optimally condition the air within the passenger compartment. The sensors include, for example, an indoor air temperature sensor 94 for determining the temperature of the air inside the passenger compartment, an outdoor air temperature sensor 96 for determining the temperature of the outside air, a solar radiation sensor 98 for determining the intensity of the solar radiation incident on the passenger compartment, a post evaporator temperature sensor 100 for detecting the actual air cooling by the evaporator, a humidity sensor 102 for detecting a relative humidity of air inside the passenger compartment and a rotational speed sensor 104 for detecting rotational speed of engine 11.

Switches for manual control of the air conditioning system 10 are provided and include, for example, a temperature setting switch 106 for setting an indoor air temperature to a desired temperature level, an indoor/outdoor air selector switch 108 for selecting outdoor air intake mode or indoor air recirculation mode, an air conditioning on/off switch 110 for turning on and off the air conditioning system, and an automatic mode switch 112 for selecting automatic air conditioning operation. Further, ACU 82 has a plurality of output ports 114 for sending control signals to the various air conditioning system components. For example, control signals are sent to the various vent doors, motors, and variable displacement compressor 60.

Figure 2A:
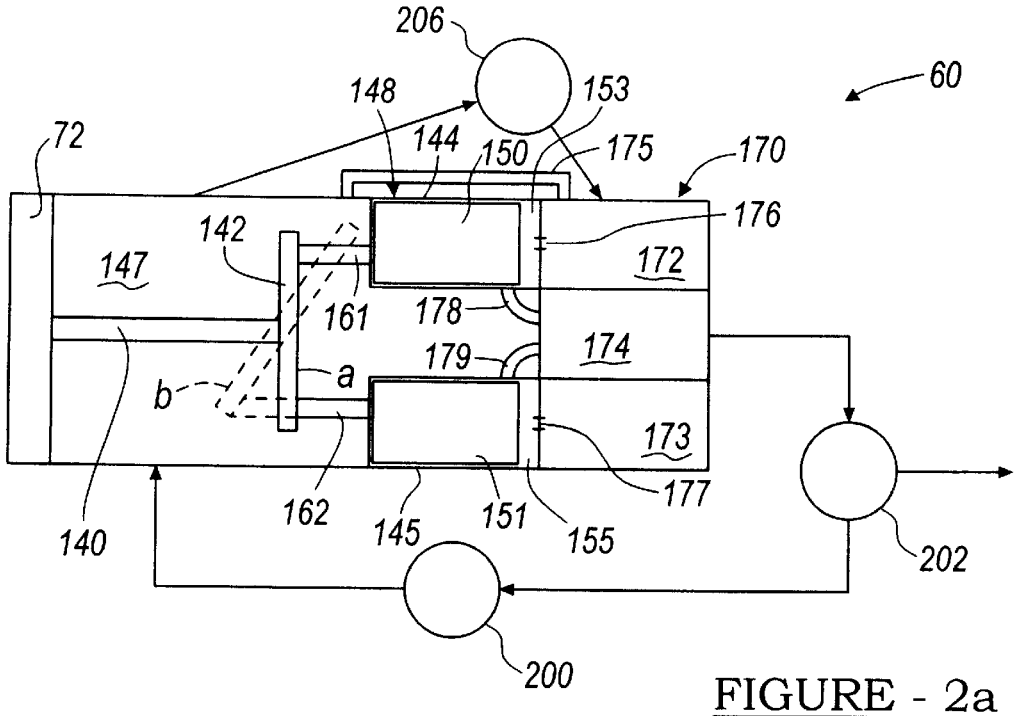
FIG. 2*a* is a schematic diagram illustrating an embodiment of a variable displacement compressor, in accordance with the present invention.

Referring now to FIG. 2*a*, a schematic diagram of variable displacement compressor 60 is shown in greater detail, in accordance with the present invention. Compressor 60 includes a driveshaft 140 which is operatively coupled to an external drive source such as a vehicle engine by an electromagnetic clutch 72. A swashplate 142 is rotatably secured to shaft 140 and is pivotable about the driveshaft. A pair of guide arms 161 and 162 are attached to swashplate 142 at a first end and to pistons 150 and 151 at a second end. The engagement between guide arms 161,162 and the associated pistons, guides the inclination of the swashplate 142 and rotates the swashplate with respect to the driveshaft 140. Driveshaft 140 and swashplate 172 are positioned within a crankcase chamber 147. The pressure in crankcase chamber 147 controls the angle of inclination of the swashplate.

Generally, compressor 60 further includes a cylinder housing 148 having cylindrical bores 144 and 145 extending therethrough. Each bore 144 and 145 accommodates one piston 150,151. Each piston and bore define compression chambers 153,155. Alternatively, each piston may be coupled to the swashplate by a pair of shoes (not shown). Rotation of the swashplate is converted into reciprocation of pistons 150,151 in bores 144,145 by means of the shoes, as well known in the art.

Further, compressor 60 includes a rear housing 170 having a suction chambers 172 and 173 and a discharge chamber 174. Suction ports 176 and 177 and discharge ports 178 and 179 are also provided at each chamber. A suction valve (not shown) is provided at each suction port for opening and closing the suction port. A discharge valve (not shown) is provided at each discharge port for opening and closing the discharge port. Further, a bypass port or orifice 175 is provided between crankcase chamber 147 and suction chamber 172.

As each piston 150,151 moves from a fully extended position to a fully retracted position refrigerant is drawn into the corresponding suction port from the suction chamber to enter the associated compression chamber. Conversely, when each piston moves from a fully retracted position to a fully extended position, the refrigerant is compressed in compression chambers 153,155 and the discharge valve opens allowing refrigerant to flow into discharge chamber 174 through associated discharge ports 178,179. The inclination of swashplate 148 varies in accordance with the difference between the pressure in crankcase chamber 147 and the pressure in compression chambers 153,155. More specifically, the difference between the pressure in crankcase chamber 147 (PC) and the pressure in the suction chambers 172,173 (PS) or the pressure difference PC−PS determines the inclination of the swashplate. PC is maintained at a pressure value that is higher than the suction pressure PS (PC>PS). An increase in the pressure difference PC−PS decreases the inclination of the swashplate. This shortens the stroke of each piston 150,151 and decreases the displacement of compressor 60. On the other hand, a decrease in pressure difference PC−PS increases the inclination of swashplate 142. This lengthens the stroke of each piston 150,151 and increases the displacement of compressor 60.

In FIG. 2*a* swashplate 142 is indicated by solid-lines (a) in first position (position a). When the swashplate is in position (a) the pistons 150, 151 do not reciprocate within chambers 153, 155. Compressor 60 is at its minimum displacement. As indicated by dashed-lines (b) the swashplate is in second position (position b). Position (b) illustrates the maximum angle of inclination the swashplate can achieve; this is also the position in which the compressor achieves its maximum displacement. Depending on the pressures in crankcase chamber 147, suction chamber 172 and discharge chamber 174 the swashplate may be inclined at any angle between position (a) and (b).

An electronic control valve 200 is in communication with the discharge chamber 174 through a refrigerant/oil separator 202 and with the crankcase chamber to control the pressure therebetween. A second electronic control valve 206 is in communication with the crankcase chamber 147 and suction chamber 172. Electronic control valves 200, 206 regulate the pressure in crankcase chamber 147, suction chamber 172 and discharge chamber 174, as will be described hereinafter.

Figure 2B:
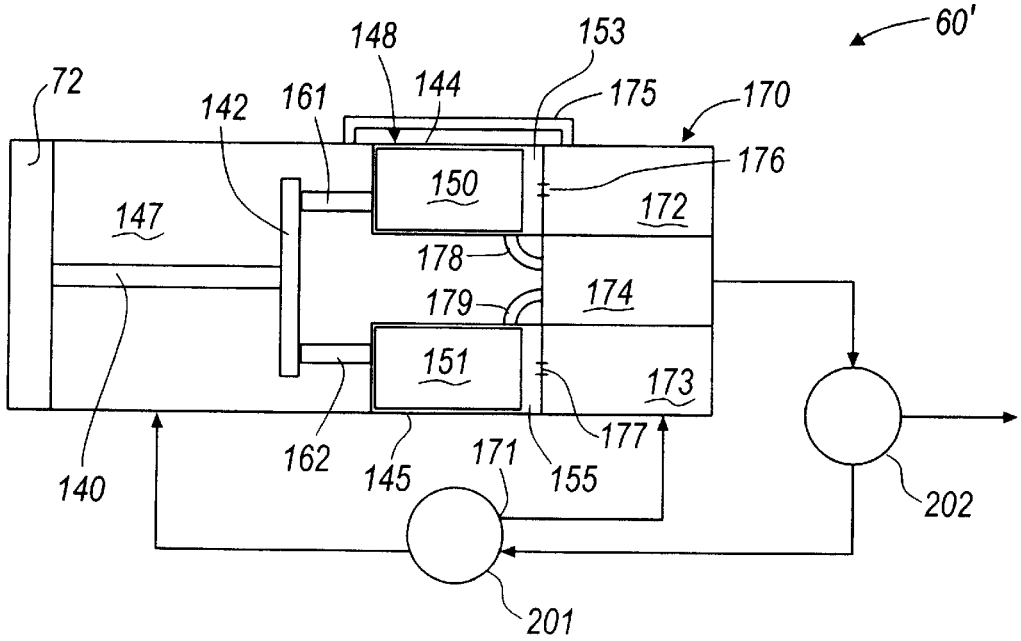
FIG. 2*b* is a schematic diagram illustrating another embodiment of a variable displacement compressor, in accordance with the present invention.

In another embodiment of the present invention, a variable displacement compressor having a single electronic control valve 201 is provided, as illustrated schematically in FIG. 2*b*. Electronic control valve 201 is used in place of control valves 200 and 206 (shown in FIG. 2*a*). For example, control valve 206, as shown in FIG. 2*a*, would be eliminated. Control valve 201 has an additional port 171 for communicating with suction chamber 173. Further, a bypass port or orifice 175 is provided between crankcase chamber 147 and suction chamber 172. Thus, the present invention controls the displacement of compressor 60' by controlling the pressure and flow of coolant through suction chambers 172, 173, discharge chamber 174 and crankcase chamber 147 using a single control valve 201.

In other embodiments of the present invention, some or all of the electronic control valves 201, 200, and 206 may be replaced my mechanical control valves. For example, in one embodiment control valve 200 is a mechanical control valve and control valve 206 is an electronic control valve. In another embodiment control valve 201 is a mechanical control valve. In each of these embodiments the control strategy described below would have to be modified accordingly to account for the mechanical control valve. However, it is preferable to use electronic control valves to achieve optimal compressor performance.

In a preferred embodiment of the present invention, a control strategy for controlling the operation of the electromagnetic control valves 200, 206 is implemented in software, or in hardware or in both software and hardware. For example, control logic for controlling the operation of control valves 200, 206, in one embodiment, is stored in the ACU's read only memory.

Figure 3:
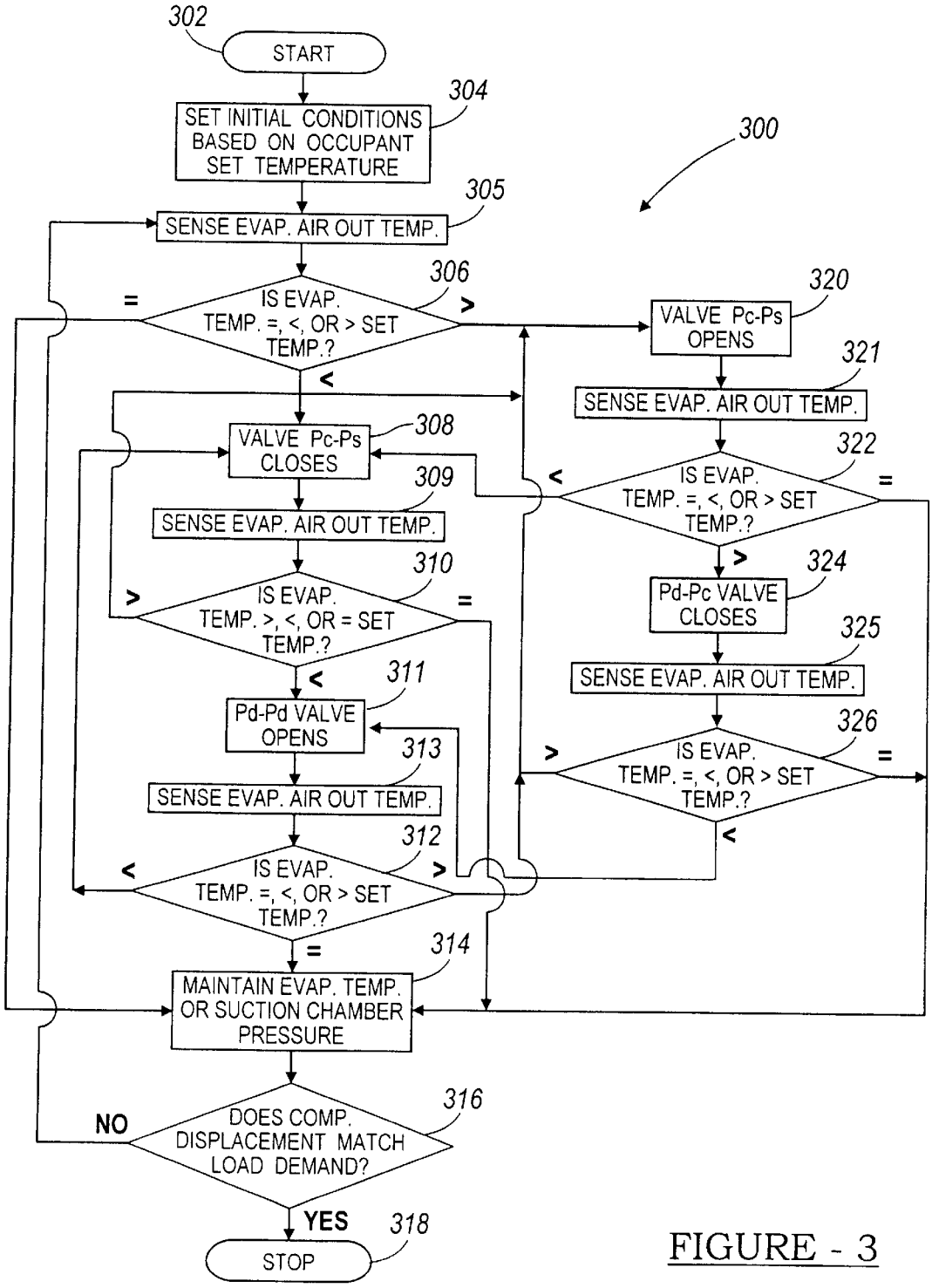
FIG. 3 is flow diagram illustrating a variable displacement compressor control strategy, in accordance with the present invention.

Referring now to FIG. 3, a variable displacement compressor and control valve strategy 300 is illustrated, in accordance with the present invention. Strategy 300 is initiated at system start up, as represented by block 302. Initial conditions are set based on a temperature selected by a vehicle occupant (occupant set temperature, $T_{set}$), at block 304. The system senses an evaporator air output temperature and a passenger compartment temperature, at block 305. At block 306, the system determines whether more cooling is needed to adjust the temperature of the passenger compartment by comparing the evaporator air output temperature ($T_{evap.}$) with the occupant set temperature. If $T_{evap.}$ is less than $T_{set}$ the electronic control valve connecting the crankcase chamber with the suction chamber closes to maintain constant flow rate as the rotation of the compressor shaft increases, as represented by block 308. This condition causes crankcase pressure to increase and refrigerant flow (M) to decrease slightly, which in turn causes the discharge pressure (PD) to decrease.

Again the system senses $T_{evap.}$, at block 309. At block 310, the system determines whether more cooling is needed by comparing $T_{evap.}$ and $T_{set}$. If $T_{evap.}$ is less than $T_{set,}$ the system opens the control valve connecting the discharge chamber with the crankcase chamber, as represented by block 311. However, if $T_{evap.}$ is greater than $T_{set}$ the valve connecting the crankcase chamber with the suction chamber opens as represented by block 320. Alternatively, if $T_{evap.}$ is equal to $T_{set}$ the evaporator air output temperature/suction chamber pressure is maintained, at block 314.

Again the system senses $T_{evap.}$, at block 313. At block 312, the system again determines whether more cooling is needed by comparing $T_{evap.}$ with the $T_{set}$. If $T_{evap.}$ is less than $T_{set,}$ the system closes the control valve connecting the crankcase chamber with the suction chamber, as represented by block 308. However, if $T_{evap.}$ is greater than $T_{set}$ then the system opens the control valve connecting the crankcase chamber with the suction chamber. Alternatively, if $T_{evap}$ is equal to $T_{set}$ the evaporator air output temperature/suction chamber pressure is maintained, at block 314.

At block 316, the system determines whether the displacement of compressor 60 matches the required cooling load. If the displacement of compressor 60 does not match the required cooling load, the process returns to block 305 and the strategy is repeated until the displacement of compressor 60 matches the required cooling load. When the system has determined that the displacement of compressor 60 matches the required cooling load, modulation of the control valves is terminated, as represented by block 318.

However, if at block 306 the system determines that $T_{evap.}$ is greater than $T_{set,}$ then the valve connecting the crankcase chamber with the suction chamber is opened, as represented by block 320. This condition causes crankcase pressure to decrease and refrigerant flow (M) to increase slightly, which in turn causes the discharge pressure (PD) to increase. Again the system senses $T_{evap.}$, at block 321. At block 322, the system again determines whether more cooling is needed by comparing $T_{evap.}$ with $T_{set.}$ If $T_{evap.}$ is less than $T_{set}$ then the system closes the control valve connecting the crankcase chamber with the suction chamber, as represented by block 308. If $T_{evap.}$ is greater than $T_{set,}$ the system closes the control valve connecting the discharge chamber with the crankcase chamber, as represented by block 324. Alternatively, if $T_{evap.}$ is equal to $T_{set}$ the evaporator air output temperature/suction chamber pressure is maintained, at block 314.

Again the system senses $T_{evap.}$, at block 325. At block 326, the system again determines whether more cooling is needed by comparing $T_{evap.}$ with $T_{set.}$ If $T_{evap.}$ is less than $T_{set}$ then the system opens the control valve connecting the discharge chamber with the crankcase chamber, as represented by block 311. If $T_{evap.}$ is greater than $T_{set,}$ the system opens the control valve connecting the crankcase chamber with the suction chamber, as represented by block 320. Alternatively, if $T_{evap.}$ is equal to $T_{set}$ the evaporator air output temperature/suction chamber pressure is maintained, at block 314.

However, if at block 306 the system determines that $T_{evap.}$ is equal to $T_{set}$ the evaporator air output temperature/suction chamber pressure is maintained, at block 314.

Thus, the present invention has many advantages and benefits over the prior art. For example, the control strategy of the present invention allows for more precise control of the crankcase pressure for a desired evaporator temperature setting. Thus, the compressor achieves stability much quicker than prior art systems.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. An air conditioning system for cooling a vehicle passenger compartment, the system comprising:

an air duct for directing air conditioned air into the vehicle passenger compartment;

refrigerant circuit for circulating a refrigerant, wherein a first portion of the circuit is exposed to the air duct end a second portion of the circuit is exposed to air external of the vehicle passenger compartment;

a variable displacement compressor in fluid communication with the refrigerant circuit, wherein the compressor having: a first control valve for regulating refrigerant flow between a compressor crankcase and a compressor discharge chamber and a second control valve, separate from the first control valve, for regulating refrigerant flow between the compressor crankcase and a compressor suction chamber a controller in electrical communication with the variable displacement compressor for controlling refrigerant flow and a displacement of the compressor by actuating the control-valves.

2. The system of claim 1 wherein the first control valve further comprises a first fluid communication port connected to the discharge chamber, a second communication port connected to the crankcase chamber, and wherein the second control valve has a first communication port connected to the crankcase chamber and a second communication port connected to the suction chamber for regulating refrigerant flow between the compressor crankcase chamber, suction chamber, and discharge chamber.

3. The system of claim 1 further comprising an evaporator disposed at the first portion of the circuit for absorbing heat from air circulating through the passenger compartment.

4. The system of claim 1 wherein the compressor further comprises a swashplate pivotable within the compressor crankcase chamber for changing the compressors displacement.

5. The system of claim 1 further comprising an evaporator outlet temperature sensor in communication with the controller for determining an evaporator outlet temperature.

6. A method for controlling an air conditioning system, having a compressor, for cooling a vehicle passenger compartment, the method comprising:

sensing an evaporator air outlet temperature;

comparing the sensed evaporator air outlet temperature to a set temperature;

actuating a first control valve wherein the first control valve is in communication with a crankcase and suction chamber of the compressor when the evaporator air temperature is one of greater than and less than the set temperature to change a state of the valve from one of open and closed;

sensing the evaporator air outlet temperature in order to determine whether the evaporator air outlet temperature has changed;

comparing the sensed evaporator air outlet temperature to the set temperature;

actuating a second control valve wherein the second control valve Is In communication with a discharge chamber and the crankcase chamber of the compressor when the evaporator air temperature is one of greater than and less than the set temperature to switch the state of the second control valve from one of an open and closed;

sensing the evaporator air outlet temperature to determine whether the evaporator air outlet temperature has changed;

comparing the sensed evaporator air outlet temperature to the set temperature; and maintaining a suction chamber pressure when the evaporator air outlet temperature is substantially equal to the set temperature.

7. The method of claim 6 wherein actuating a first control valve wherein the first control valve is in communication with a crankcase and suction chamber of the compressor when the evaporator air temperature is less than the set temperature to change the state of the valve to closed.

8. The method of claim 6 wherein actuating a first control valve wherein the first control valve is in communication with a crankcase and suction chamber of the compressor when the evaporator air temperature is greater than the set temperature to change the state of the valve to open.

9. The method of claim 6 wherein actuating a second control valve wherein the second control valve is in communication with a discharge chamber and the crankcase chamber of the compressor when the evaporator air temperature is less than the set temperature to change the state of the valve to open.

10. The method of claim 6 wherein actuating a second control valve wherein the second control valve is In communication with a discharge chamber and the crankcase chamber of the compressor when the evaporator air temperature Is greater than the set temperature to change the state of the valve to closed.

* * * * *

UNITED STATES PATENT AND TRADEMARK OFFICE

CERTIFICATE OF CORRECTION

PATENT NO. : 6,840,054 B2
DATED : January 11, 2005
INVENTOR(S) : Srinivas S. Pitla et al.

It is certified that error appears in the above-identified patent and that said Letters Patent is hereby corrected as shown below:

Column 7,
Line 44, after "air duct" delete "end" and substitute -- and -- in its place.
Line 54, after "chamber" insert -- said valves being operated independently of one another; and --.
Line 58, delete "control-valves" and substitute -- control valves -- in its place.

Column 8,
Line 6, delete "compressors" and substitute -- compressor's -- in its place.
Line 30, delete "Is In" and substitute -- is in -- in its place.
Line 61, after "valve is" delete "In" and substitute -- in -- in its place.
Line 64, before "greater than" delete "Is" and substitute -- is -- in its place.

Signed and Sealed this

Twenty-third Day of August, 2005

JON W. DUDAS
*Director of the United States Patent and Trademark Office*